US005456070A

United States Patent [19]

Lin et al.

[11] Patent Number: 5,456,070

[45] Date of Patent: Oct. 10, 1995

[54] ROTATOR FOR A TWISTER

[75] Inventors: Chun-Yen Lin, Street No. 10, Chien Ping 6th Street, Tainan; Yong-Tseh Su, Tainan Hsien, both of Taiwan

[73] Assignee: Lin; Chun-Yen, Tainan, Taiwan

[21] Appl. No.: 309,978

[22] Filed: Sep. 20, 1994

[51] Int. Cl.[6] ..... D01H 7/86

[52] U.S. Cl. ..... 57/58.61; 57/58.76; 57/58.78; 57/58.83

[58] Field of Search ..... 57/58.61, 58.76, 57/58.78, 58.83

[56] References Cited

U.S. PATENT DOCUMENTS

| | | | |
|---|---|---|---|
| 2,143,203 | 1/1939 | Maxham | 57/58.78 X |
| 3,338,043 | 8/1967 | Franzen | 57/58.76 |
| 3,956,875 | 5/1976 | Lenorak | 57/58.61 |
| 5,361,571 | 11/1994 | Joyce | 57/58.76 |

FOREIGN PATENT DOCUMENTS

| | | | |
|---|---|---|---|
| 7875 | 2/1980 | European Pat. Off. | 57/58.61 |
| 1560260 | 7/1970 | Germany | 57/58.76 |

*Primary Examiner*—Joseph J. Hail, III

*Attorney, Agent, or Firm*—Morton J. Rosenberg; David I. Klein

[57] ABSTRACT

A rotator for a twister for twisting yarn at more than two double twists for each rotation is provided. The rotator includes a rotating member, a stationary member and a tubular rod coupled together. Between a center rod and a point in an L-shaped passageway in the rotator and a bending point at a small guide wheel is produced respectively double twists to the yarn. A rectangular frame of the rotator member rotates with the rotator member so as to force the portion of yarn between a top hole in the frame and the bending corner of the L-shaped passageway to produce more double twists. Thus, at least two double twists are produced for each rotation of the rotator member to increase the speed of twisting yarn.

1 Claim, 8 Drawing Sheets

ROTATOR FOR A TWISTER

BACKGROUND OF THE INVENTION

This invention concerns a rotator for a yarn twister. More particularly, this invention is directed to a yarn twister for twisting yarn with more rounds than a conventional rotator for a yarn twister does.

In a yarn spinning process, yarn is twisted for increasing its strength and for giving a smooth feeling after being woven into cloth. A known conventional twister 10, shown in FIG. 7, includes a plurality of boards 20 dividing the machine into a plurality of work sections 30. Each work section 30, as shown in FIG. 8, has a base plate 40, a rotator 60 fixed upright on the base plate 40, and a winder 50 fitted on the rotator 60. Then yarn 50' on the winder 50 goes through the top of the rotator 60 into the interior thereof, comes out of a side of the bottom thereof, goes up and passes through a ring 70, around a guide wheel 80 above the ring 70, guided by a large guide wheel 90 and then finally wound around a reel 200 rotated by a roller 100. Twisting of yarn is effected by rotation of the rotator 60, which has its bottom rotated by a belt 300 continuously moved by a power source. A brake 400 is provided to stop the rotator 60.

How yarn is twisted during moving and running through the rotator 60 is to be described as follows.

Referring to FIG. 9, the rotator 60 includes a rotating member 1 and stationary member 2 and a tubular rod unit 3 combined together.

The rotating member 1 has a bottom block 11 provided with an L-shaped passageway 111, an annular cone-shaped wall 12 on the block 11, a pivotally coupled rod 13 in the passageway 111, and two bearings 131 secured around the rod 13. The rod 13 has centrally located vertical hole 132 formed therein. A rotating spindle 14 is coupled to the bottom of the block 11 to be rotated by a belt 300. A shaft 15 is affixed to the bottom of the spindle 14 and supported upright in a hole formed in the base plate 40.

The stationary member 2 is pivotally coupled to the rotating member 1, having a bottom disc 21, and a center post 211 disposed in the bottom disc 21. The post 211 has a centrally located vertical hole 212 formed in an upper portion thereof, and a large vertical hole formed in a lower portion of the post 211. An annular wall 22 is firmly fixed to the disc 21. An annular small magnet 23 is secured to an inner side of the wall 22 and a large annular magnet 24 is provided in spaced corresponding relationship around the annular wall 22 with respect to the inner annular magnet 23, for mutual attraction therebetween. The center post 211 is biased by a soft cushion 25 disposed under an upper rod 26, the upper rod 26 having a center hole 261 formed therethrough. A locating block 27 is secured around the upper rod 26.

The tubular rod unit 3 has a hollow rod 31, with a plurality of tension adjusters 32 disposed within the hollow rod 31, as shown in FIG. 10. Each adjuster 32 has a cylindrical body 321 with a cone-shaped soft cushion 322 disposed in the body 321 and defining a hollow region 323. A steel bead 325 is movably disposed within the hollow region, the bead 325 being disposed at the bottom of the hollow region over a hole 324 formed through the bottom of the body 321, so as to adjustably press yarn 50' passing through the hole 324 to provide the yarn with a proper tension. A cap 33 is threadedly secured to the top of the hollow rod 31. A threaded rod 34 is threadedly engaged with a nut 331 disposed on the cap 33 and has a center through hole 341. Another nut 342 engages the upper end of the threaded rod 34. A stopper 35 is disposed on the nut 342 and a block 36 is disposed on the stopper 35. A cushion 37 is disposed on the block 36, with a connecter 38 being disposed on the cushion 37. A head 39 having a yarn hole formed therethrough is threadedly connected with the connector 38.

In the twisting yarn process, the tubular rod unit 3 is lifted up, and a cylinder 50" of the winder 50 is placed around the hollow rod 31. Then the rod unit 3 together with the cylinder 50" is placed on the locating block 27 of the stationary member 2. After that, yarn 50' on the winder 50 is inserted through the head 39 into the interior of the rotator 1, through the center holes of the components, and out of the L-shaped passageway 111 of the bottom block 11. The yarn 50' then goes up through the ring 70, around the small guide wheel 80 and then is wound around the reel 200. The rotator 1 rotates with the bottom base 15, which is rotated by the rotating post 14, by means of the belt 14. The stationary member 2, the winder 50 and the tubular rod units 3 stay motionless, are not rotating, because of the small magnet 23 and the large magnet 24 attracting each other. The yarn 50' moving in the rotator 60 is twisted by the cooperation between the related parts which are motionless and those which are moving. That is, the vertical portion of the yarn, between the head 39 and the bending corner 500 of the L-shaped passageway 111, is kept in a neutral position, while the portion of the yarn 50' in the horizontal portion will be twisted by the rotation of the rotator 60 for one twist between a yarn relieving point 500' of the yarn 50' and the bending corner 500. Then the portion of the yarn between the outer opening of the passageway 111 and the bending point 500' of the small guide wheel 80 will be twisted for a second twist between the bending corner 500 and the bending corner 500'. In other words, this conventional twister produces two twists for one rotation between the yarn relieving point 500" to the bending corner 500 and the bending corner 500 to the bending 500'.

SUMMARY OF THE INVENTION

The less revolutions yarn is twisted in a twister, the lower the speed of twisting will be. The purpose of this invention is to offer a rotator for a twister, which can twist yarn at more than double two twists for each rotation of the rotator so that the twisting speed of yarn may be increased.

BRIEF DESCRIPTION OF THE DRAWINGS

The invention will be better understood by reference to the accompanying drawings, wherein.

DESCRIPTION OF THE PREFERRED EMBODIMENTS

Figure 1:
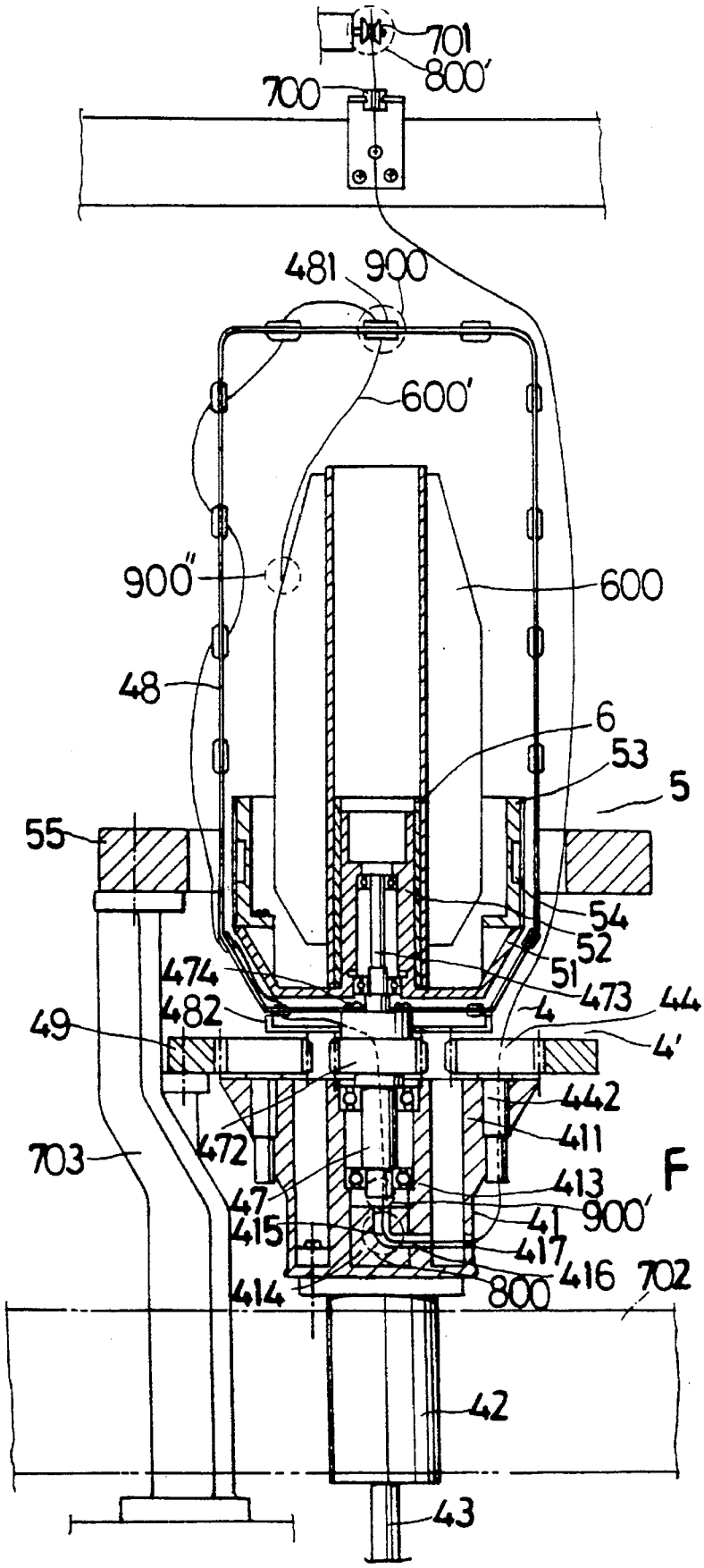
FIG. 1 is a cross-sectional view of a rotator for a twister of the present invention.
Figure 2:
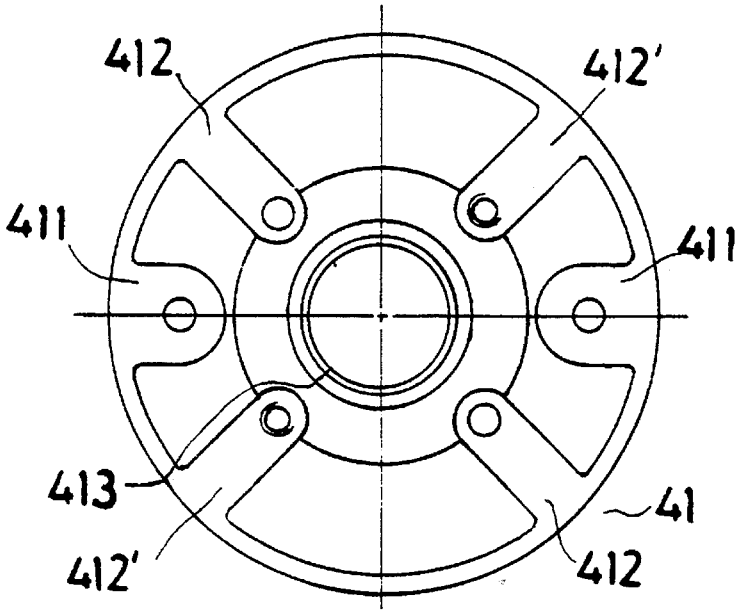
FIG. 2 is an upper view of a turning disc in the rotator for a twister of the present invention.

As shown in FIG. 1, a rotator in a twister of the present invention includes a rotating member 4, a stationary member 5 and a rod 6 coupled together.

The rotating member 4 has a turning disc 41 with a transmission means 4'. The rotating member 4 further has a rotating post 42 extending down from under the turning disc 41, which is rotated by a belt 702, and a shaft 43 secured in a central hole (not shown in the Figure) formed in the bottom base of the twister. The rotating disc 41 has two small opposing outwardly protruding ears 411, 411 and two pairs of opposing outwardly protruding long ears 412 and 412' in addition to the two ears 411, 411 for mounting the transmission means 4'. The rotating disc 41 also includes a central tubular post 413, a guide block 414 with an L-shaped passageway 415 disposed at the bottom of the tubular post 413. A hole 416 is formed through the wall of the tubular post 413 and a hole 417 is formed through the wall of the turning disc 41, both holes being in open communication with the passageway 415.

Figure 3:
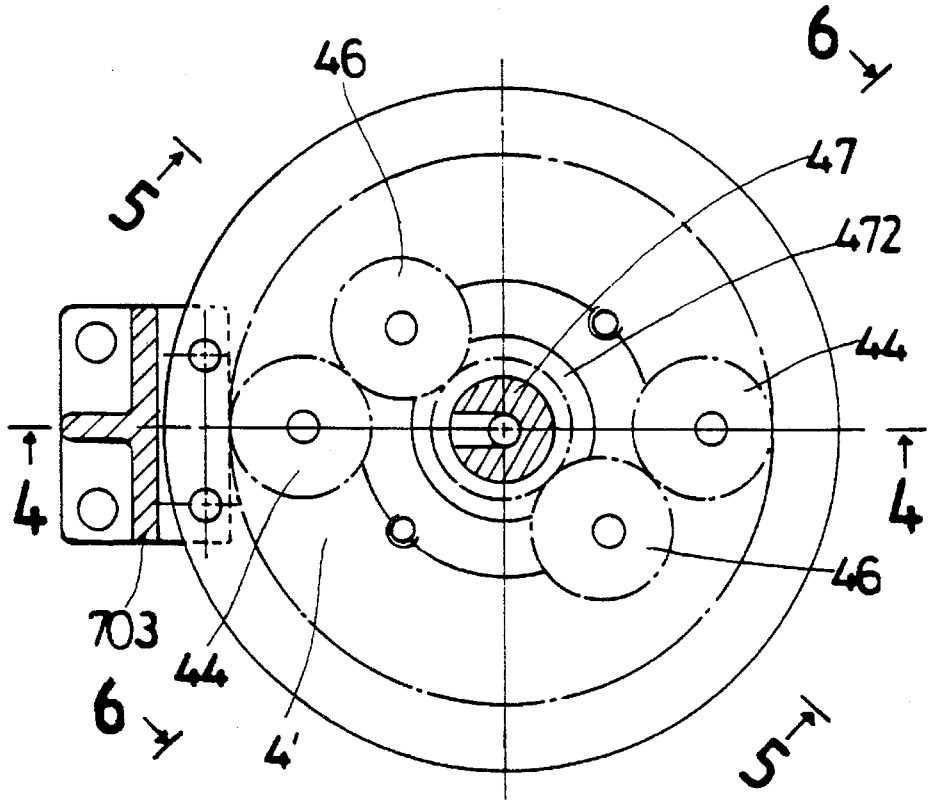
FIG. 3 is an upper view of a rotating member of the rotator for a twister of the present invention.
Figure 4:
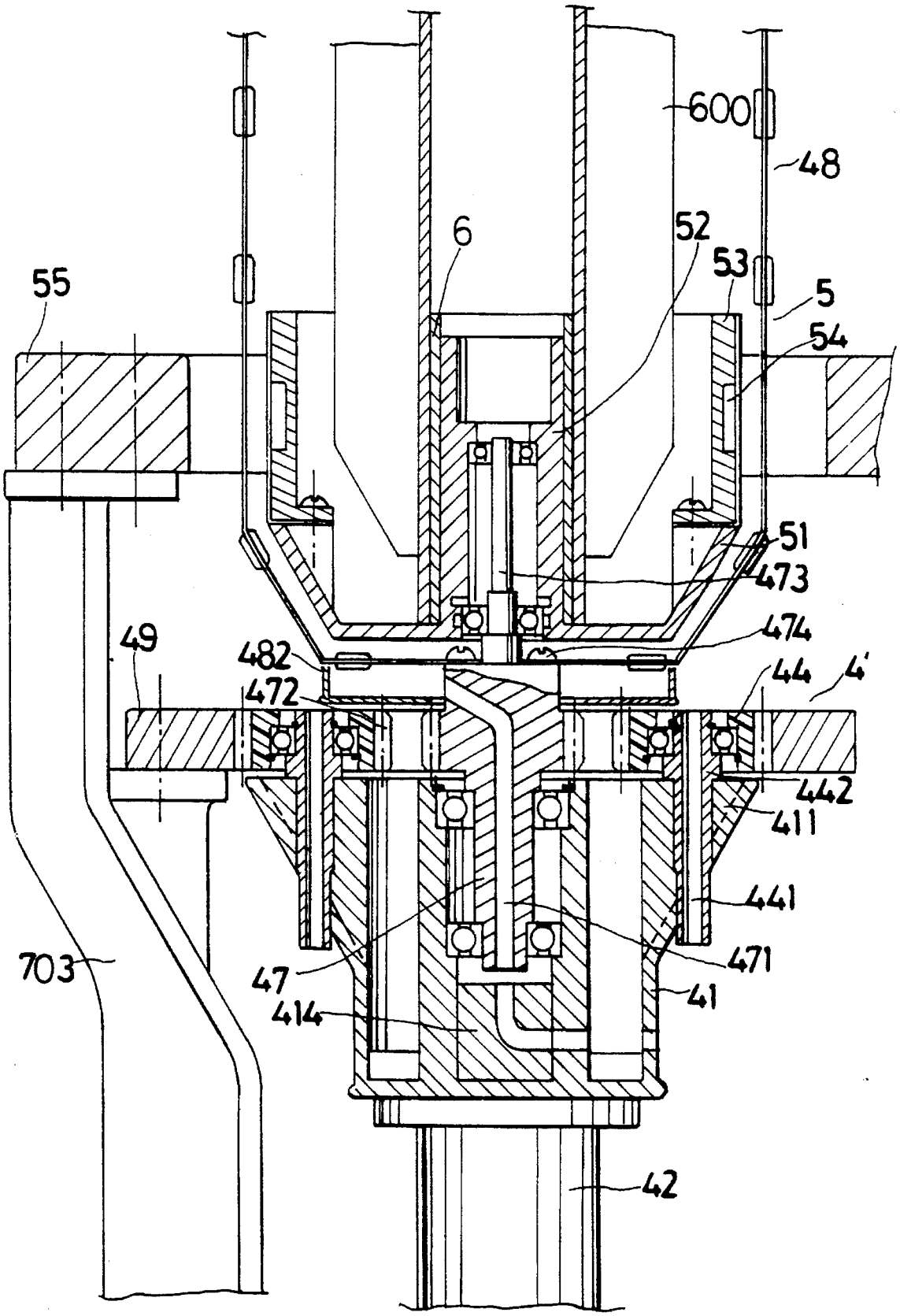
FIG. 4 is an enlarged cross-sectional view taken along the section line 4—4 of FIG. 3.
Figure 5:
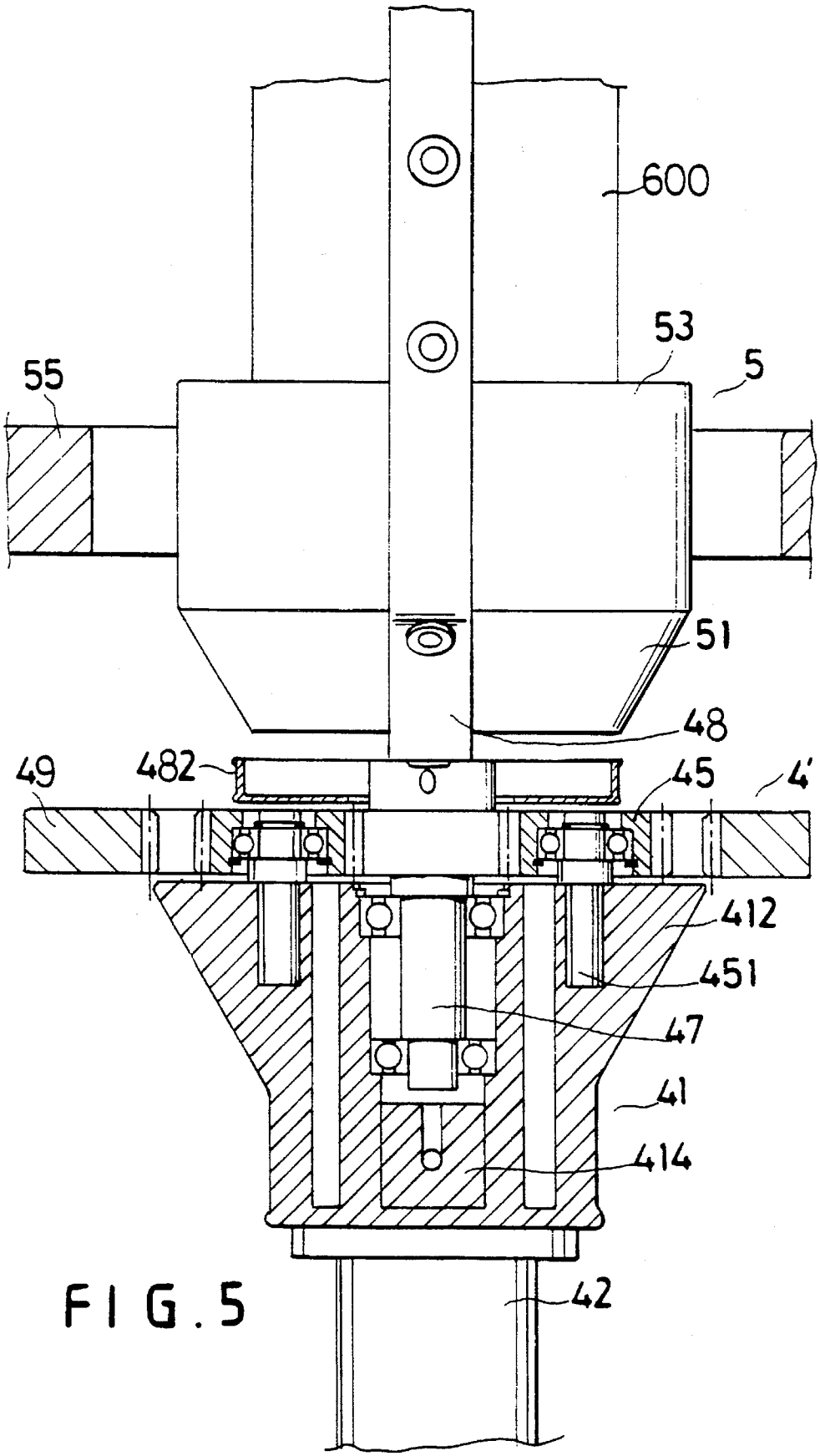
FIG. 5 is an enlarged cross-sectional view taken along the section line 5—5 of FIG. 3.
Figure 6:
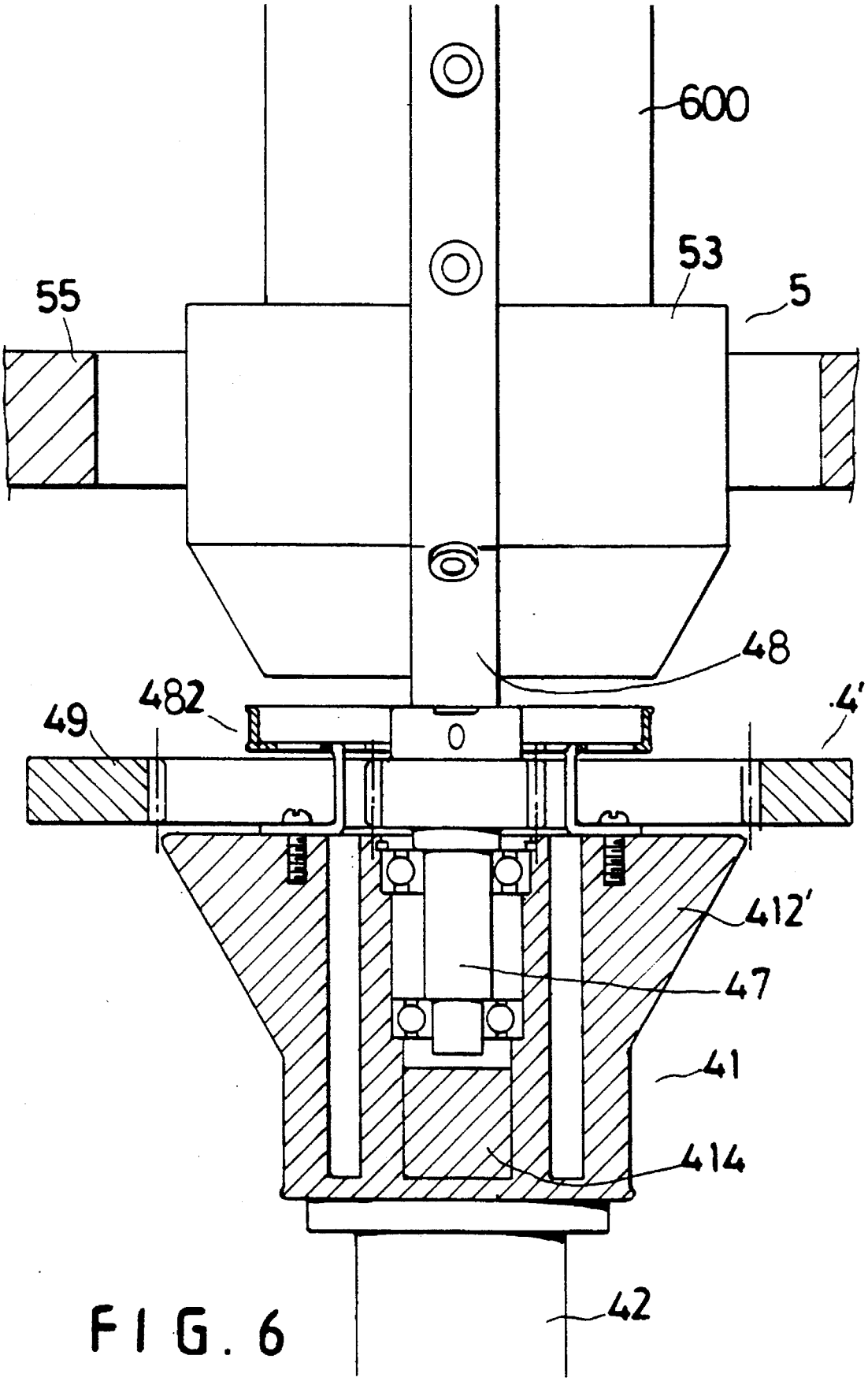
FIG. 6 is an enlarged cross-sectional view taken along the section line 6—6 of FIG. 3.
Figure 7:
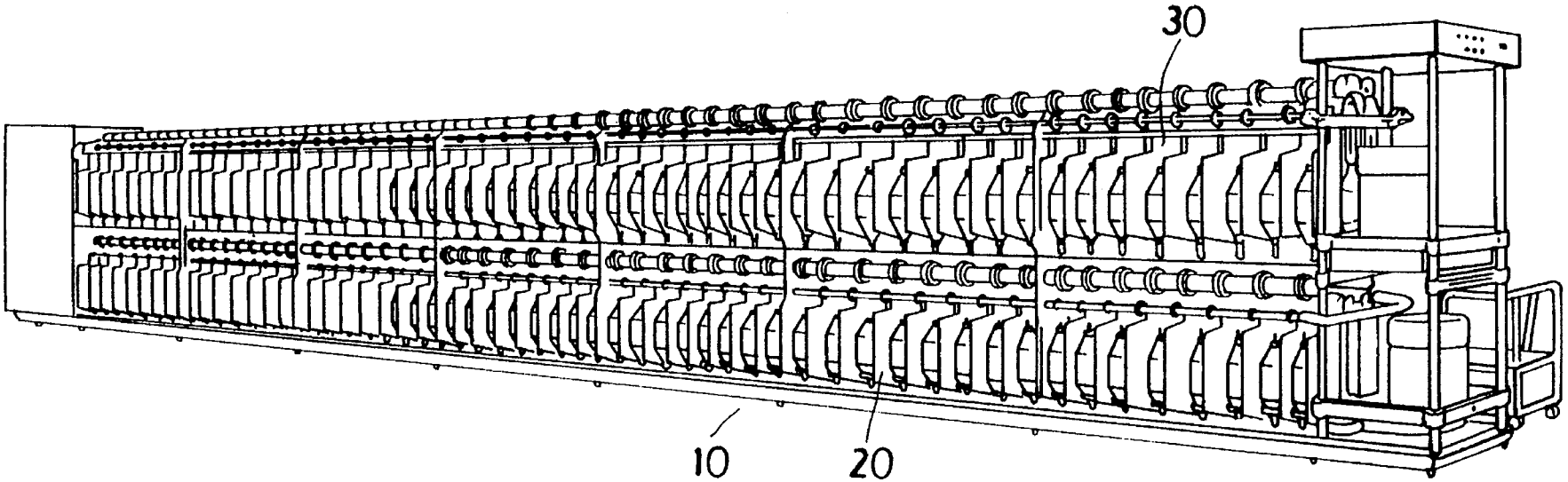
FIG. 7 (PRIOR ART)
FIG. 7 is a perspective view of a conventional twister.
Figure 8:
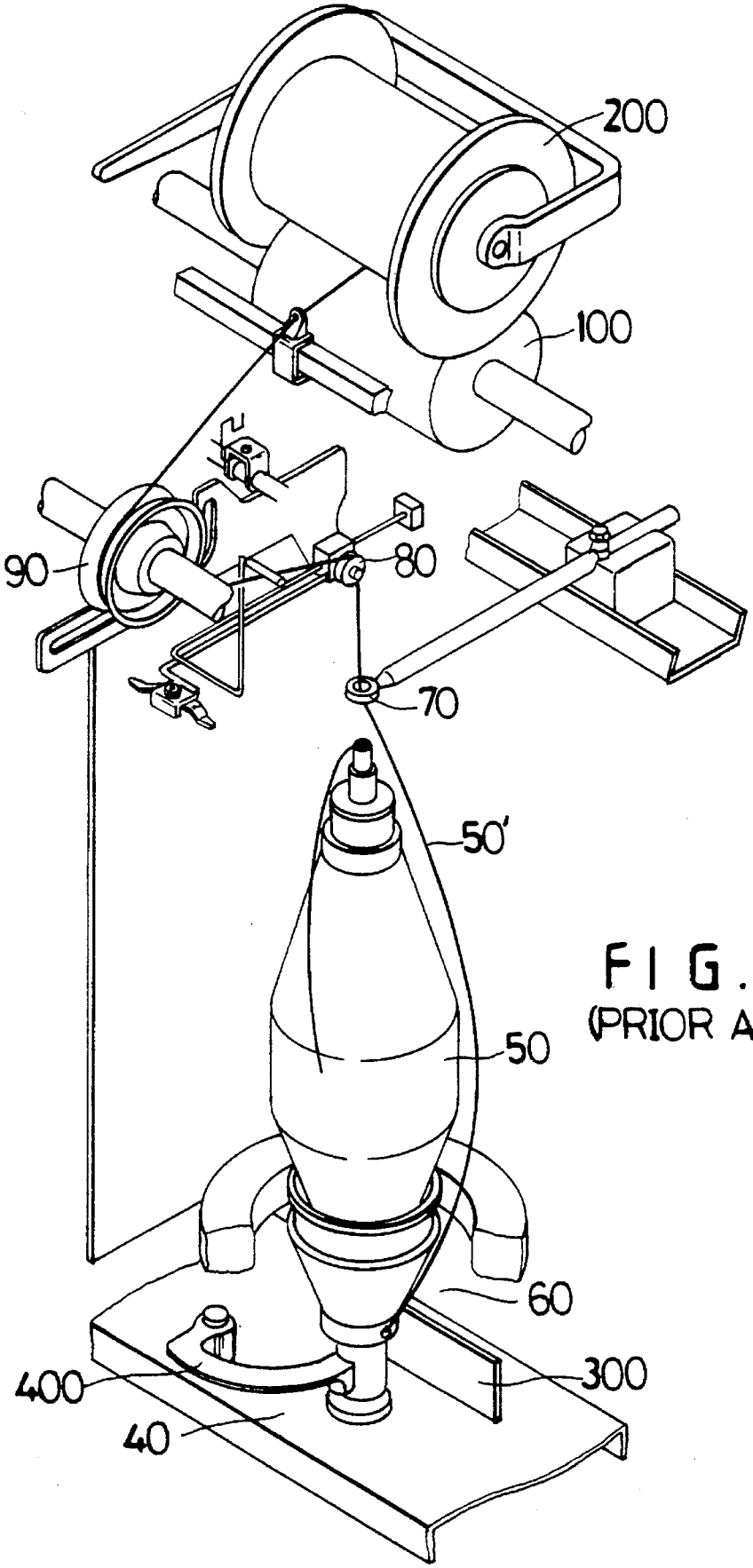
FIG. 8 (PRIOR ART)
FIG. 8 is a perspective view of a partial work area of the conventional twister.
Figure 9:
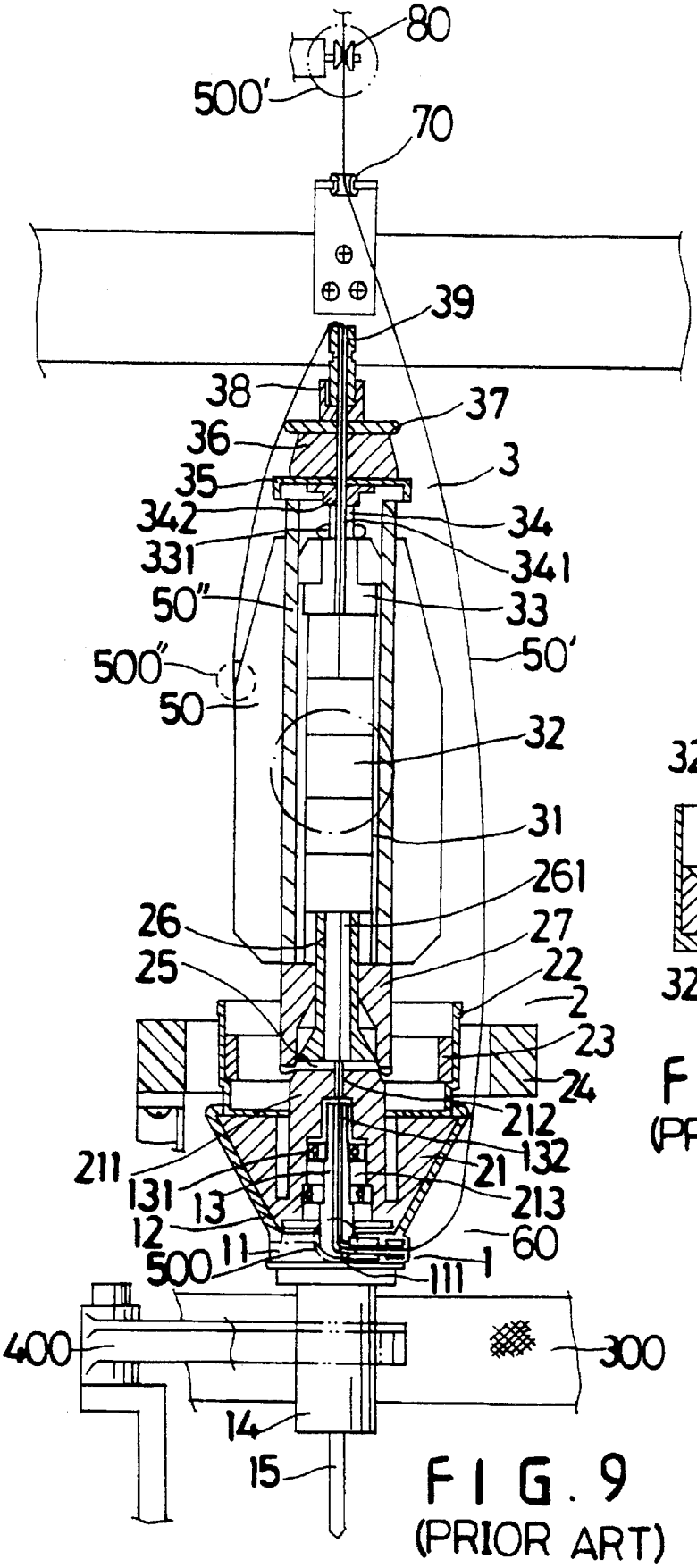
FIG. 9 (PRIOR ART)
FIG. 9 is a cross-sectional view of a rotator in the conventional twister; and, FIG. 10 is a cross-sectional view of a tension adjuster of the rotator in the conventional twister.
Figure 10:
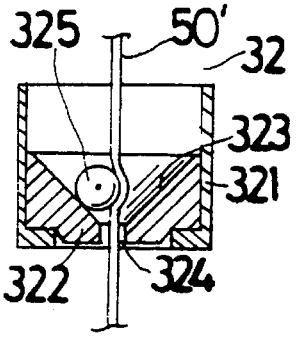
FIG. 10 (PRIOR ART)

As shown in FIGS. 3, 4 and 5, the transmission means 4' includes a tubular rod 442, a gear 44, a vertical tubular rod 451, an idle gear 46 and an internal gear 49. Each of the two ears 411, 411 receive a vertical tubular rod 442 therein, each tubular rod having a center through hole 441. The gear 44 is pivotally coupled to the top of the tubular rod 442. Each of the two ears 412, 412 receive a vertical tubular rod 451, the idle gear 46 being coupled to the top of the tubular rod 451 and in meshing engagement with the gear 44. The tubular post 413 of the turning disc 41 has a center rod 47 secured thereto by means of a bearing. The center rod 47 has a central passageway 471 and a gear 472 coupled to the top thereof for meshing engagement with the idle gears 46 of the transmission means 4'.

A post 473 is provided to extend up from the top of the center rod 47 by means of a bearing. A rectangular frame 48 is provided to be combined with the top of the center rod 47 by bolts 474. The frame 48 has a plurality of holes 481 spaced equidistantly along its body. A round disc 482 is secured to the outwardly protruding long ears 412' beneath the frame 48. A frame body 703 of the twister is located beside the rotator 1, and having the internal gear 49 secured thereto for meshing engagement with the two gears 44, 44 of the transmission means 4'.

The stationary member 5 is pivotally coupled with the top of the post 473. The stationary member 5 has a bottom plate 51, a tubular post 52 extending up from the center of the plate 51, and an annular wall 53 coupled to the bottom plate 51. A small annular magnet 54 is affixed on an inner side of the annular wall 53, and a large annular magnet 55 is secured on the frame body 703 and encircles the annular wall 53.

The tubular rod 6 is fixed on the tubular post 52 of the stationary member 5.

In a practical twisting process, referring to FIG. 1, a thread winder 600 is disposed on the tubular rod 6, and a yarn 600' from the thread winder 600 is passed through a hole 481 in the top of the frame 48. The yarn 600' is then passed through other of the holes 481 in two sides of the frame 48, to provide the needed tension. Then, the yarn 600' is passed through the center passageway 471 of the tubular rod 47, the L-shaped passageway 415, the holes 416, 417. The yarn 600' then is passed through the center hole of the tubular rod 442, a gap disposed between the frame 48 and the large annular magnet 55, a hole in a ring 700. The yarn 600' is pulled upward via a small guide wheel 701.

Just as in a conventional twister, the twister in the present invention has its rotating post 42 rotated by the belt 702, by which the rotator 4 is rotated. By the rotation transmitted through the gears, the turning direction of the turning disc 41 is opposite to that of the tubular rod 47, so as to produce a twist between a point 900' of the L-shaped passageway 415 and the tubular rod 47, and a corner 800 of the L-shaped passageway 415. Another twist is also produced between the corner 800 of the L-shaped passageway 415 and a bending point 800' of the small guide wheel 701. Therefore, at least two twists are produced between the point 900' and the bending point 800'.

In addition, as the rectangular frame 48 also rotates, the yarn 600' will be twisted for a twist between the relieving point 900" of the thread winder 600 and the bending point 900 at the top hole 481 in the frame 48. Moreover, between the bending point 900 at the top hole 481 of the frame 48 to the L-shaped passageway 415 and the point 900' of the tubular rod 47 another twist is produced. Therefore, at least two twists more are produced between the relieving point 900" and the point 900'. More than two twists for each rotation are produced due to the difference of rotation of the gears 44, 44,472, and 49 of the transmission means 4'. That is, while the turning disc 41 turns through one revolution, the gear 472 of the center rod 47 turns through several revolutions, and the portion of the yarn 600' between the relieving point 900" and the point 900' is twisted for a plurality of double twists.

For example, suppose the internal gear 49 has 80 teeth and the gears 44, 44 and 472 and the idle gears 46, 46 all have 20 teeth, and clockwise rotation is defined as positive and the counterclockwise rotation as negative. When the turning disc 41 turns −1 revolution, the gears 44, 44 turn +4 (80/20) revolutions, meshing with the internal gear 49. The idle gears 46, 46 turn +4 revolutions, and the gear 472 turns +4 revolutions, meshing with the internal gear 49. But, the practical rotation of the gear 472 is +3 (+4+(−1)=+3), because the gear 472 turns −1 together with the turning disc 41. Thus the yarn between the relieving point 900" and the point 900' is to be twisted three doubles, i.e. six twists, and the yarn between the point 900' and the bending point 800' is twisted one double, so the total twists the yarn receives will be eight twists.

Besides, the round disc 482 coupled to the ears 412' at the bottom of the rectangular frame 48 can force the yarn to wind on itself, caused by the rotation of the rotator 4, after the yarn 600' passes out of the center hole 441 of the tubular rod 442, increasing stabilizing force of twisting.

While the preferred embodiments of the invention have been described above, it will be recognized and understood that various modifications may be made therein and the appended claims are intended to cover all such modifications which may fall within the spirit and scope of the invention.

What is claimed is:

1. A rotator for a twister, comprising:

a vertically extending stationary frame, said stationary frame having an annular gear extending transversely therefrom and a first annular magnet extending transversely from an upper portion of said stationary frame, said annular gear having teeth formed on an internal surface thereof;

a rotating portion pivotally supported adjacent said stationary frame and meshingly engaged with said annular gear, said rotating portion including:

a. a rotating post drivingly coupled to an external motive power source;

b. a turning disc coupled to said rotating post for rotation therewith, said turning disc having a vertically directed passage formed therein and a transversely directed passage extending from an external surface of said turning disc to said vertically directed passage for providing open communication therebetween, said turning disc having a plurality of radially extending ears, each of said plurality of ears having a vertically directed opening formed therethrough; and c. transmission means coupled to said turning disc for transmitting rotative displacement therefrom, said transmission means including (1) a pair of first gears pivotally coupled to a respective opposing pair of said plurality of ears of said turning disk for rotation therewith, (2) a pair of second gears pivotally coupled to a respective opposing pair of said plurality of ears of said turning disc and meshingly engaged with said annular gear, each of said pair of second gears being meshingly engaged with a respective one of said first pair of gears, each of said second gears having a centrally located through bore disposed in aligned relationship with a respective through opening of said ear, and (3) a third gear pivotally coupled to said turning disc and meshingly engaged with said pair of first gears, said third gear having a centrally located through opening formed therein and disposed in aligned relationship with said vertically directed passage of said turning disc;

a stationary portion magnetically coupled to said support frame, said stationary portion including a bottom member having an annular wall disposed in spaced concentric relationship with said first annular magnet to define a gap between said annular wall and said first annular magnet, said bottom member having a tubular post extending vertically therefrom for receiving a spool of yarn thereon;

a second annular magnet coupled to said annular wall of said bottom member in aligned relationship with said first annular magnet, said second annular magnet having a polarity selected to provide magnetic coupling therebetween and substantially prevent rotation of said bottom member; and, a counter rotating frame coupled to said third gear for rotation in a direction opposite to a direction of rotation of said turning disc, said counter rotating frame having a plurality of openings formed therethrough for passage of yarn from a spool of yarn sequentially through a selected number of said plurality of openings of said counter rotating frame, said transmission means having a predetermined gear ratio for rotating said counter rotating frame a multiple of each rotation of said turning disc to thereby increase twisting of yarn passed through said counter rotating frame, twisting of yarn being further provided by passage thereof from said counter rotating frame through (1) said through opening in said third gear, (2) said vertically directed passage, (3) said transversely directed passage, (4) a selected one of said vertically directed openings formed in a respective turning disc ear, (5) said centrally located through bore of a respective one of said pair of second gears, and (6) said gap before being wound on a reel.

* * * * *